US005507059A

United States Patent [19]

Hohner

[11] Patent Number: 5,507,059

[45] Date of Patent: Apr. 16, 1996

[54] AUTOMATICALLY FEEDING ELECTRICALLY POWERED ERASER

[76] Inventor: Jack Hohner, 2310 N. Fancher Rd., Suite B, Spokane, Wash. 99212

[21] Appl. No.: 497,793

[22] Filed: Jul. 3, 1995

[51] Int. Cl.[6] ..... B43L 19/00

[52] U.S. Cl. ..... 15/3.53

[58] Field of Search ..... 15/3.53, 424

[56] References Cited

U.S. PATENT DOCUMENTS

| | | | |
|---|---|---|---|
| 2,917,023 | 12/1959 | Cohen | 120/36 |
| 3,070,379 | 12/1962 | Misuraca | 279/35 |
| 3,224,417 | 12/1965 | Misuraca | 120/36 |
| 3,903,558 | 9/1975 | Anderson | 15/353 |

FOREIGN PATENT DOCUMENTS

| | | |
|---|---|---|
| 757953 | 1/1934 | France . |
| 829561 | 1/1952 | Germany . |
| 249887 | 7/1947 | Switzerland . |
| 277691 | 9/1951 | Switzerland . |

*Primary Examiner*—David Scherbel
*Assistant Examiner*—Terrence R. Till
*Attorney, Agent, or Firm*—Keith S. Bergman

[57] ABSTRACT

An electrically powered eraser accepts an elongate circularly cylindrical erasing element between three driving rollers symmetrically arrayed about the erasing element with axes angulated to the axes of the other driving cylinders and to the axis of the erasing element so that the driving cylinders contact the erasing element near its exit end. The three driving cylinders are positionally maintained in a housing extending thereabout and are interconnected for similar rotary motion by driving bands, gears or the erasing element itself. At least one of the driving cylinders is powered to rotate all cylinders in the same direction to cause the erasing element to rotate and move axially from the exit end of the rollers by reason of roller rotation.

6 Claims, 2 Drawing Sheets

AUTOMATICALLY FEEDING ELECTRICALLY POWERED ERASER

BACKGROUND OF INVENTION

RELATED APPLICATIONS

There are no applications related hereto heretofore filed in this or any foreign country.

1. Field of Invention

This invention relates generally to powered erasing machines and more particularly to such a machine that automatically extends an elongate cylindrical erasing element to compensate for wear responsive to rotation of the eraser.

2. Background and Description of Prior Art

Electric erasing machines have been known and used for some period of time and during the course of their history their use has become well established, especially in the drafting and graphic arts fields. Most erasing machines have provided elongate abrading type erasing element formed of rubber or similar material that is carried in a body casement, with one erasing element and projecting from the casement for application to a surface to be erased. The erasing element generally is releasably carried in the tool for adjustable extension to compensate for eraser wear and is mechanically rotated by electric or pneumatic power means that may be carried in or otherwise associated with the body casement. The instant invention provides a new and improved tool of this general class.

By reason of the nature of the erasing process, which causes abrasion on the outer end portion of an erasing element, it is necessary to continuously adjust the positioning of the erasing element relative to the tool that carries and rotates it. In general, the cantilevered portion of an erasing element that projects beyond its support in an erasing tool requires adjustment within a fairly limited range of extension to provide proper erasing action. If the projection of the erasing element is too great, it tends to be too elastic to not allow proper force to be exerted upon a surface being erased to cause the abrasion necessary for the erasing process. If the erasing element projection is too little, the pressure on the erasing surface tends to increase, the cone on the eraser tends to be too blunt and the erasing process becomes inefficient, if in fact possible because of chatter and heat.

The requirement for frequent adjustment of eraser extension from an erasing tool has heretofore been recognized and dealt with by various devices that have become known to aid such adjustment. U.S. Pat. No. 2,917,023 issued to Cohen in 1959 shows an erasing machine with a collet holding an elongate erasing element so that the collet may be moved to release the erasing element for outward motion responsive to a biasing force created by a compression spring. U.S. Pat. No. 3,070,379 issued to Misuraca in 1962 shows an elongate erasing element of non-circular cross-section that is carried in an inertial chuck which prevents lineal motion of the erasing element only during periods of its rotation, so that it may be manually moved relative to the erasing tool during inoperative periods. This type of erasing element adjustment, though beneficial, is not automatic and requires manual intervention by an operator to change position of the erasing element relative to the erasing tool.

The instant device, in contradistinction, provides an erasing tool that automatically, by reason of its operation and without manual intervention of an operator, mechanically feeds an elongate erasing element outwardly from the tool's driving mechanism responsive to rotation of the erasing element by that driving mechanism. This type of eraser element feed may be used in hand-held eraser structures of the type that are presently known and the operation of such eraser tools is the same as that with which users have been habitually familiar. The driving and feeding mechanism of the tool also allows use of traditional erasing elements of circularly cylindrical configuration and traditional size that are readily available in the present day marketplace. My mechanism is particularly well adapted for mechanically positionable powered erasing tools for plotters and the like, such as that disclosed in U.S. Pat. No. 4,991,116 issued Feb. 5, 1991 to the instant inventor.

A further advantage of my eraser feeding system is that it provides a frictional type driving mechanism for rotating the cylindrical eraser element that is of a simple mechanical nature to provide greater reliability, smoother operation and lower cost of manufacture. The driving mechanism provides no chuck or collet as such, but rather constitutes three circular cylinders that are angled to each other and to the axis of an erasing element carried therebetween. The erasing element is not mechanically interconnected with the cylinders, but rather is only frictionally engaged by the cylinders so that slippage may occur between the erasing element and the cylinders to prevent damage to the tool or material being erased by reason of the application of excessive force on the erasing element to create excessive friction between the erasing element and workpiece. The parameters determining the amount of frictional engagement between the driving cylinders and the erasing element may be adjusted to prevent generation of excessive heat in the erasing element caused by the application of excessive frictional force between that element and a workpiece. This type of frictional drive also alleviates the use of gear drives and other complex mechanical interconnections between a motor and the erasing element driving mechanism.

My invention resides not in any one of these features individually, but rather in the synergistic combination of all of its structures that necessarily give rise to the functions flowing therefrom.

SUMMARY OF INVENTION

My invention generally provides a powered erasing tool having a casement carrying three similar driving cylinders in spacedly adjacent array to define a channel therebetween to accept an elongate cylindrical eraser in frictional contact therewith. The three driving cylinders are journaled in the casement, with axes similarly angulated to each other and to the axis of the erasing element. The driving cylinders may define annular grooves at one or both ends to receive elastomeric bands extending thereabout for radially inward biasing and maintenance of similar rotary motion of each cylinder. The casement defines an exit orifice through which the erasing element extends for operative contact with a workpiece.

In a first species designed especially for mechanically supported and moved erasing tools, the three cylinders define innermost radially larger driving heads and are powered by a motor carried by the casement with a driving cylinder extending between the three driving cylinder heads to simultaneously engage those heads for rotation. In a second species designed especially for manual support and motion, the driving cylinders define similar belt grooves about their inner portions that carry an elastomeric band extending thereabout and spacedly therefrom to engage the driving pulley of a motor carried within the tool casement for simultaneous rotation of all driving cylinders. In either species of erasing tool the rotary motion of the driving cylinders is frictionally transmitted to rotate the erasing element and the erasing element moves axially outwardly relative to the driving cylinders by reason of their angulation to the erasing element axis.

In providing such a device, it is:

A principal object to provide an electrically powered erasing tool that rotates an elongate cylindrical erasing element and moves that erasing element axially responsive to its rotation without manual intervention.

It is a further object to provide such an erasing tool that accepts standard cylindrical erasing elements of present day commerce and may be used in either manually manipulatable or mechanically supported and movable erasing tools.

It is a further object to provide such an erasing tool that has an eraser driving mechanism comprising three spacedly adjacent cylindrical elements, angulated to each other and similarly angulated to the axis of an erasing element carried therebetween, to create a simple frictional driving mechanism.

A further object is to provide such an erasing tool that may have endless elastomeric bands extending about the driving cylinders to bias them radially inwardly toward each other to allow driving of the cylinders by a driving trundle carried therebetween in engagement with each driving cylinder.

A still further object is to provide such a tool that has an elastomeric band extending about grooves defined in the outer surface of the inner end portions of the driving cylinders and spacedly distant therefrom to extend about a driving pulley driven by a motor within the casement for powering of the driving cylinders.

A further object is to provide such an erasing tool that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention, however, it is to be understood that its features are susceptible to change in design and structural arrangements with only the preferred and practical embodiments of the best known modes being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
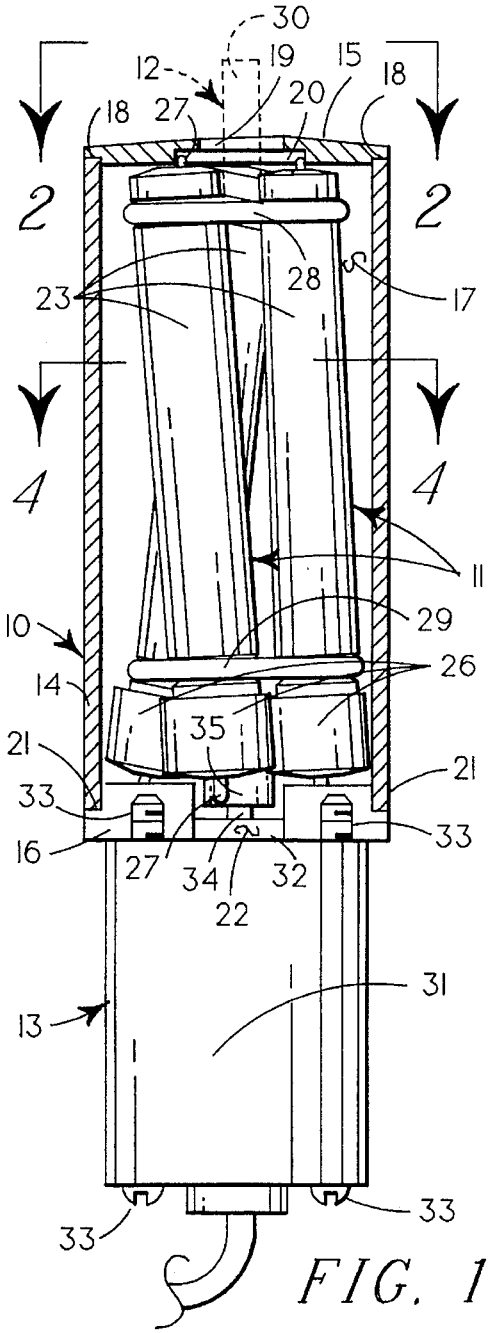
FIG. 1 is an orthographic elevational view of a first species of my erasing tool, with the casement partially cut-away to show the driving mechanism.

The first species of my erasing tool, illustrated in FIGS. 1–4, generally provides casement 10 enclosing driving mechanism 11 that engages elongate erasing element 12 to move that element rotatably and axially responsive to rotation of motor 13.

Casement 10 is a peripherally defined cylindrical structure, in the instance illustrated having medial circularly cylindrical body portion 14 carrying forward or lower end plate 15 at a first end and rearward or upper end plate 16 at its second end to define medial chamber 17. The forward end plate 15 defines peripheral groove 18 to receive the forward end portion of the cylindrical body 14 in a mortise type joint. The medial portion of the forward end plate 15 defines eraser orifice 19 having annular roller groove 20 defined thereabout in the upper or rearward portion of the forward end plate.

Rearward end plate 16 defines groove 21 about its forward periphery to receive the second end of cylindrical body 14 in a mortise type joint. The medial portion of the rearward end plate 16 defines orifice 22 to receive a collar of an electric motor and allow passage of driving mechanism of that motor from a position rearwardly of the rearward end plate 16 into casement chamber 17. At least one of the end plates 15 or 16 is releasably carried by the body cylinder 14 to allow assemblage of the driving mechanism within the casement chamber 17. Releasable fastening of the casement elements may be accomplished by appropriate known means such as mechanical fasteners that communicate between the elements or various resiliently deformable fastenable joints (not shown).

Figure 3:
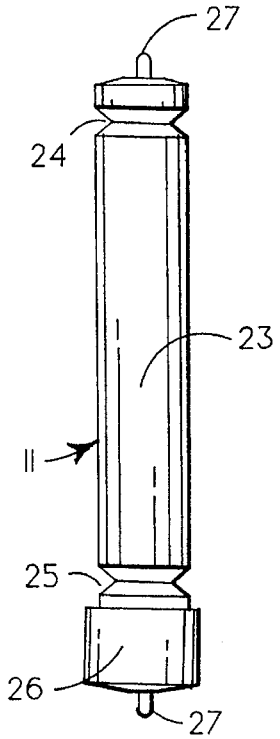
FIG. 3 is an isometric surface view of one of the driving cylinders of the driving mechanism of FIG. 1, isolated to show its detailed configuration.
Figure 4:
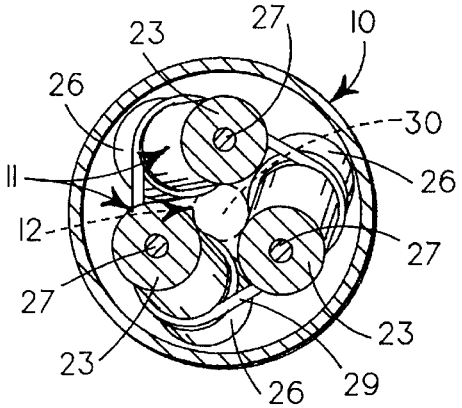
FIG. 4 is a medial transverse cross-sectional view through the driving mechanism of FIG. 1, taken on the line 4—4 thereon in the direction indicated by the arrows.
Figure 2:
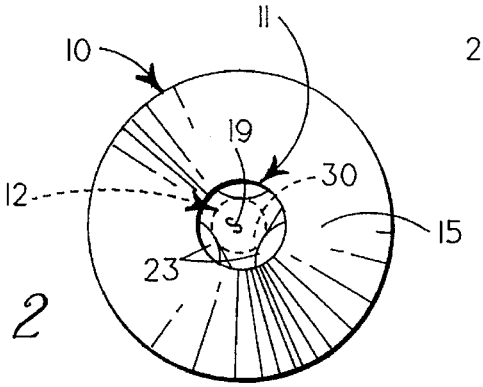
FIG. 2 is a forward end view of the tool of FIG. 1, taken on the line 2—2 on that Figure in the direction indicated by the arrows thereon.

Driving mechanism 11 provides three similar driving cylinders 23, one of which is isolated in elevational view in FIG. 3. Each driving cylinder 32 is of circular cross-section and defines a forward drive band groove 24 inwardly adjacent its forward end and a similar rearward drive band groove 25 inwardly adjacent its rearward end. The rearward portions of each cylinder 23, rearwardly of rearward drive band groove 25 are somewhat radially larger than the driving cylinders to define driving heads 26. The driving mechanism includes three such driving cylinders which are maintained in adjacency by forward elastomeric drive band 28 and rearward elastomeric drive band 29, each of such configuration as to fit within the forward and rearward drive band grooves respectively and maintain the adjacent end portions of the cylinders in adjacency with some biasing force when an erasing element is carried in a medial area between the driving cylinders. Each driving cylinder 23 carries an axially aligned pin 27 that extends spacedly from each end of the driving cylinder carrying it, and the peripheral portions of both ends of the driving cylinders are somewhat chamfered to allow a better and more compact fit within the casement chamber 17, so that those cylinders may freely rotate without interference from the walls of the casement defining the casement chamber.

The dimensioning and configuration of the driving cylinders 23 are critical to the operation of my erasing tool. The axial length of the driving cylinders is incrementally less than the distance between the adjacent surfaces of the forward end plate 15 and rearward end plate 16, but such that when the inner end portions of the driving cylinders are in contact with the forward surface of the rearward end plate, cylinder pins 27 will extend into cylinder groove 20 in the forward end plate and journals in the rearward end plate to be supported therein for positional maintenance of the roller cylinders. The diametrical dimension of each driving cylinder is such that the space between rollers is incrementally less than the diameter of a cylindrical erasing element to be carried between the driving cylinders, so that the forward portions of the cylinders will exert some force on the eraser element by reason of their bias toward each other as caused by forward band 28. The driving heads 26 are of such radial dimension that they maintain the rearward portions of the driving cylinders 23 at a distance from each other such that they do not contact the erasing element therebetween, but do frictionally engage the surface of a motor cylinder extending between the rearward portions of the driving heads.

Preferably the driving cylinders 23 are formed of some rigid material such as metal or one of the harder, more dense polymeric or resinous plastics which generally create sufficient friction, when engaged on the surface of an elastomeric erasing element, to allow operation of my device. If higher friction is required on the surfaces of the driving cylinders, it may be obtained by traditional methods of roughening the cylinder surfaces or coating them with higher frictional materials. The forward and rearward drive bands 28 and 29 are formed of some elastomeric material, preferably rubber or an elastic polymer such as are commonly used in smaller machines for similar purposes.

Erasing element 12 is an elongate cylindrical eraser 30 of the type presently commercially available for use in other electric erasing tools. These erasers commonly are of one-quarter inch diameter and are available in various lengths. The length of an eraser usable in the first species of my erasing tool is limited substantially to the distance from the forward surface of a driving cylinder to a point spacedly forwardly of the forward surface of forward end plate 15 that allows sufficient forward projection of the eraser beyond the forward end plate to accomplish the erasing function. The radial dimensioning of the erasing element is not critical, so long as it is related to the other configurational parameters of my erasing tool as herein set forth.

Motor 13 provides cylindrical, peripherally defined motor casement 31 having forwardly extending collar 32 that fits within the driving cylinder orifice 22 defined in the rearward end plate 16. The motor is releasably carried on the rearward surface of rearward end plate 16 in axial alignment therewith by mounting bolts 33 extending through the casement 31 and into threaded engagement with the rearward end plate. The motor provides forwardly extending drive shaft 34 which irrotatably carries motor cylinder 35. The motor cylinder 35 is of such radial dimension as to extend between the driving heads 26 of the driving mechanism to support them in spaced relationship as hereinbefore provided. The axial length of the motor cylinder 35 is such that it engages at least the rearward portions of the driving heads 26 but does not extend forwardly thereof so that it does not interfere with an eraser 30 carried by the forward portions of driving cylinders 23.

Figure 5:
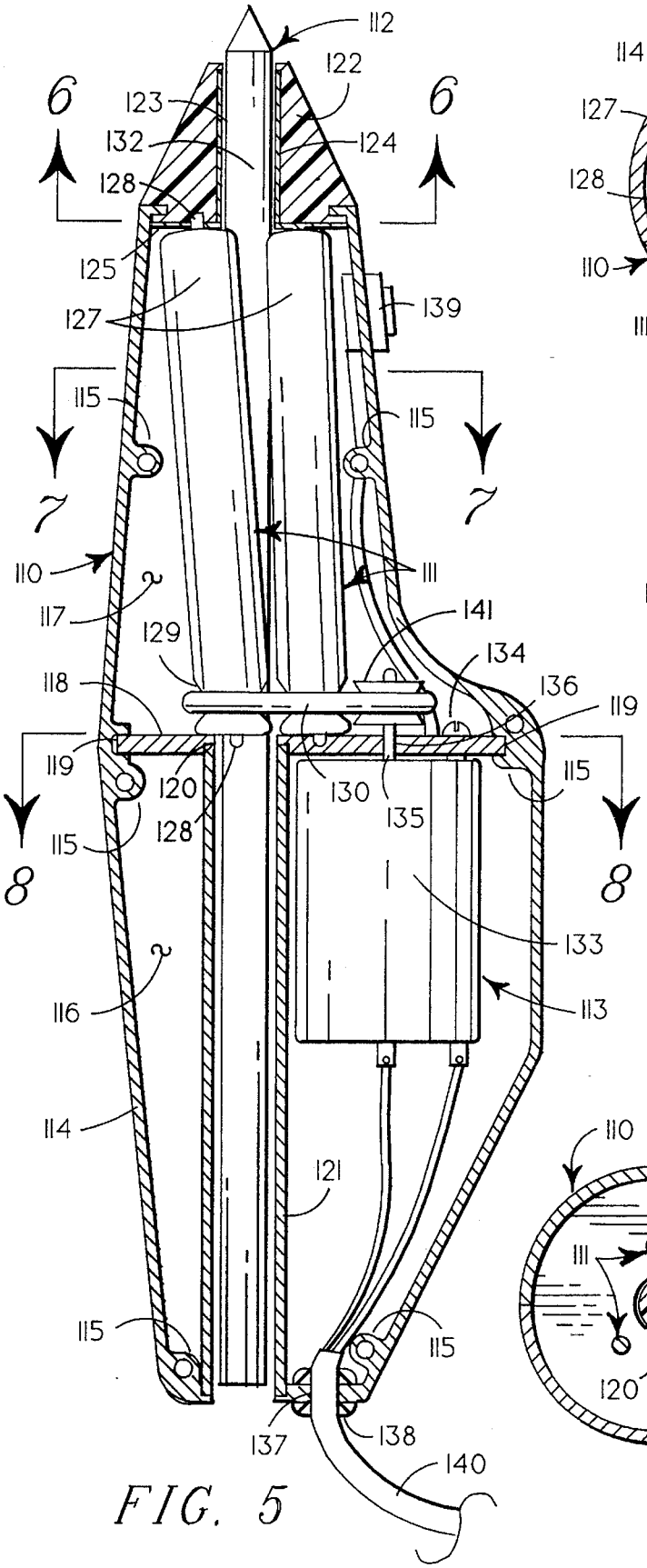
FIG. 5 is an elongate cross-sectional view of a second hand-held species of my erasing tool.

A second hand-held and hand-manipulatable species of erasing tool is illustrated in FIGS. 5, et seq. This species of tool in general provides casement 110 carrying driving mechanism 111 in its forward portion, erasing element 112 extending lineally through the casement and driving mechanism, and motor 113 in the medial rearward portion of the casement.

Casement 110 is an elongate, peripherally defined member of somewhat elliptical cross-sectional shape and overall curvilinear configuration to provide a reasonably conformable and comfortable fit within the hand of a user. The casement is formed by two similar half portions 114 releasably joined by fasteners (not shown) extending between inwardly projecting fastening protuberances 115. The chamber defined by the casement is divided into a rearward portion 116 and a forward portion 117 by medial septum 118 supported in channels 119 defined in the inner surface of casement 114. The medial septum 118 defines an eraser orifice 120 to allow passage of an eraser through the septum. Rearward eraser support tube 121 extends from the rearward surface of medial septum 118 to the rearward portion of casement 114 and defines a channel coincident with orifice 120 that is incrementally larger than an erasing element to be carried therein so that the erasing element may freely move. The rearward portion of casement 110 defines motor cord orifice 137 lined by insulative grommet 138.

The forward portion of the casement 110 supports truncated conical nose piece 122 defining medial eraser channel 123. The eraser channel is aligned with forward eraser tube 124 defining a channel incrementally larger than the erasing element to be carried therein and axially aligned with rearward eraser support tube 121. The rearward surface of nose piece 122 carries forward septum 125 which provides additional strength and support and journals for the driving mechanism.

Driving mechanism 111 provides three similar driving cylinders 127 each having mounting pin 128 extending in axial alignment therethrough and spacedly beyond each end of the cylinder. Each driving cylinder defines annular drive band channel 129 inwardly adjacent its rearward portion to accept continuous circular drive band 130 in a frictionally conformable fit. The length of driving cylinders 127 is incrementally less than the distance between the adjacent surfaces of medial septum 118 and forward septum 125.

Figure 7:
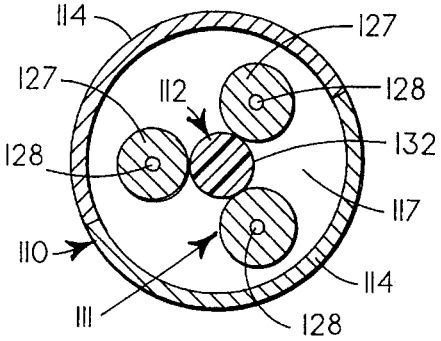
FIG. 7 is a transverse cross-sectional view of the tool of FIG. 5, taken on the line 7—7 thereon in the direction indicated by the arrows.
Figure 6:
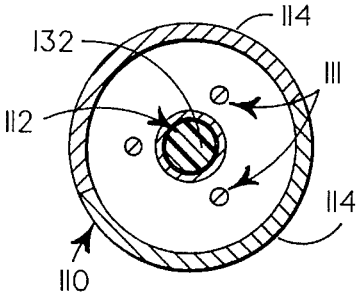
FIG. 6 is a transverse cross-sectional view of the tool of FIG. 5, taken on the line 6—6 thereon in the direction indicated by the arrows.
Figure 8:
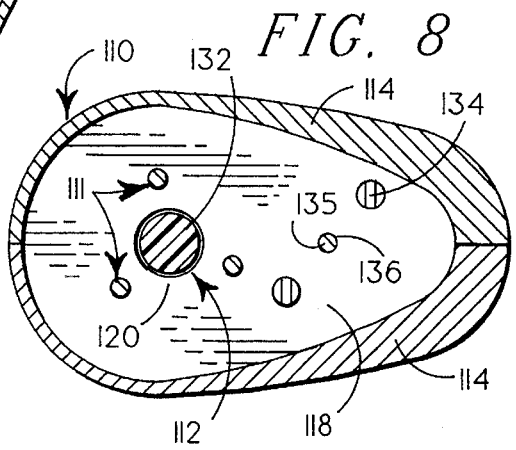
FIG. 8 is a transverse cross-sectional view of the tool of FIG. 5, taken on the line 8—8 thereon in the direction indicated by the arrows.

As illustrated particularly in FIGS. 6 and 7, the forward septum 125 defines three cylinder mounting pin holes arrayed symmetrically about the eraser channel defined in that element and medial septum 118 defines three cylinder mounting pin holes in similar radial symmetry about eraser orifice 120 defined in the medial septum. The cylinder pin holes in the forward septum are related to those in the rearward septum so that the axes of driving cylinders 127 are angulated slightly, at an angle of about three to five degrees, inwardly in a forward direction toward the axis of the eraser channel. The cylinder pin holes are radially spaced to angularly position the driving cylinders so that their forward portions will contact an erasing element extending therebetween, while the rearward portions of those driving cylinders will be sufficiently spaced so as not to contact an eraser. Contact between the forward portions of the driving cylinders and an erasing element therebetween should be sufficient to create some frictional force between the contacting surfaces to rotate and move the erasing element axially responsive to driving cylinder rotation.

Erasing element 112 provides elongate cylindrical eraser 132 of ordinary commercial design as used with the first species of my tool. Preferably the eraser should have an external diameter of approximately one-quarter inch and substantially the same characteristics as erasers in the present day marketplace used for similar purposes. The length of the eraser is not critical as it may extend both forwardly and rearwardly of the erasing tool and is limited only by practicalities of the erasing operation, as herein set forth.

Motor 113 provides casement 133 which is carried in rearward chamber 116 on the rearward surface of medial septum 118 by bolt fasteners 134 extending in threaded engagement through the septum and into the motor casement. The motor 113 provides forwardly extending drive shaft 135 extending through drive shaft orifice 136 defined in the medial septum 118 and spacedly forwardly therebeyond. Drive shaft 135 irrotatably carries drive band pulley 141 at a spaced distance forwardly of the medial septum, such that drive belt 130 operatively extends about the drive band pulley and the drive band channel 129 defined in at least one of the driving cylinders 127 so that rotary motion may be imparted by the motor 113 to at least one of the driving cylinders 127. The motor 113 is powered through electric cord 140 that passes through insulative grommet 138 to communicate with an external source of electrical power (not shown). A normally off motor control switch 139 is provided in the forward portion of casement 114 where it may be conveniently accessed by the hand of a user supporting the tool to operate the motor when required for an erasing function.

Having thusly described my erasing tool, its operation may be understood and that operation is similar for either species.

Firstly, an erasing tool of either species is created according to the foregoing specification and an erasing element inserted in an operative position therein. In the first species of tool, an erasing element of proper length is inserted at the forward end of the tool through orifice 19 defined in forward end plate 15 and between the driving cylinders 23. This insertion may be accomplished by manual manipulation exerting sufficient force on the eraser element to move it as desired or optionally, the eraser or the driving cylinders, if possible, may be rotated in a direction that causes the eraser to move inwardly between the driving cylinders until the eraser insertion is complete. In the second species of erasing tool, the eraser may be similarly established between the driving cylinders 127 by manual manipulation or it may be more conveniently inserted in a forward direction through the rearward orifice of the rearward eraser support tube until it frictionally engages the forward portion of the driving cylinders 127, at which point the eraser motor may be operated to rotate the eraser and move it forwardly into proper operative position, with the forward portion extending spacedly forwardly of nose piece 122.

For operation of either species, my tool is moved into a position whereat the forward portion of an eraser carried therein comes into contact with the surface of a workpiece at a point where an erasure is to be made. The motor of the tool is operated to cause rotation of the eraser to create an erasing action on the workpiece in the traditional fashion of similar presently known erasing tools. The first species of eraser, commonly will be mounted by brackets or similar attachment means to some mechanical device such as the head of a plotter or similar mechanism that moves the eraser over the course of material that is to be erased. The motor commonly will be switched between null and operative states by traditional known circuitry operated by an associated controlling device such as a computer or its peripherals. In the case of the second species, the tool normally will be manually manipulated to move it to a proper position and subsequently will be moved along a course that is to be erased by appropriate manual manipulation. The motor of the second species will be operated manually by the normally off switch 139 that is carried on the lower portion of the casement.

Commonly, though not necessarily, the erasing element will be maintained with its axis at an angle to a plane through the surface of the material on which erasure is being accomplished. With such positioning in the erasing process, the outer end portion of an eraser will be abraded and removed to create a conical point, as illustrated in FIG. 5. Normally such a point is desirable to provide a relatively small area of eraser contact with a surface being erased to provide erasing accuracy and enhance the erasing process. The erasing process in my tool is similar in nature to that of other rotary erasing tools of present day commerce that do not have my automatic feeding feature. The various parameters of my tool relating to the erasing process may be adjusted to maximize the efficiency of the process, such as the amount of extension of the eraser forwardly of its support, the rigidity of the eraser material, the abrasiveness of that material the size and angulation of the eraser, the pressure upon the tool and similar parameters according to principles heretofore known.

As the motor operates in either species of tool, driving cylinders, or at least one of them, will rotate and since the forward portions of all driving cylinders are in frictional contact with the eraser extending therebetween, the rotary motion of the powered driving cylinder or cylinders will be transmitted to the eraser to cause responsive rotation of the eraser. Since the cylindrical periphery of the driving cylinders constitutes a ruled surface and since the ruling elements forming that surface are angulated to the axis of the eraser cylinder, the force exerted by the driving cylinders will create a vector having a major component perpendicular to a ruling element of the eraser periphery and a minor component parallel to that ruling element to impart a motion that both rotates the eraser and moves it in an axial direction at the same time. The direction of axial motion of an eraser depends upon the direction of rotation of the driving cylinders and by varying that direction of rotation, an eraser may be moved either inwardly into or outwardly from the driving cylinders. The parameters associated with the relative magnitude of perpendicular components of a vector representing force imparted by the driving cylinders to move an eraser may be varied within limits by methods well known in the engineering arts, such as changing the angulation between or the relative size of the driving and driven elements. If the motor driving my erasing tool be of reversible nature, an eraser element may be moved inwardly or outwardly relative to the driving cylinders by operation of the motor.

It should be noted that with the first species of my tool, although a frictional linkage between the motor driving cylinder is disclosed, that linkage may also be accomplished by a geared-type linkage which would serve the same purposes, although the geared linkage may be more expensive and possibly not so reliable. Such geared type linkage, however, is within the ambit and scope of my invention.

It should further be noted that the so-called "erasing element" or "eraser" is actually a type of abrading element and that the amount of abrasion accomplished by the element may vary with the nature of that element. The terms "erasing element" and "eraser" as used herein should therefore be construed to include abrading elements of the flexibly resilient nature of a traditional eraser and the configuration specified, though they be used for grinding, polishing or similar non-erasing purposes. Such abrading elements include a composite material formed of a rubber-like matrix embodying abrasive particles that are exposed in the abrading process and may be covered with a peripheral coating of lower abrasive nature that may be removed during the abrading process to prevent excessive abrasion of the driving cylinders.

The foregoing description of my invention is necessarily of a detailed nature so that a specific embodiment of its best known modes might be set forth as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. A mechanically powered tool that rotates and axially moves an elongate cylindrical abrading element responsive to the rotation of the tool, comprising in combination:

a casement having forward and rearward ends defining a chamber for containment of driving mechanism and at least one orifice in the forward end for passage of an abrading element;

driving mechanism journaled within the casement chamber comprising three similar elongate driving cylinders, having forward end portions and rearward end portions, arrayed in spaced adjacency to define a passageway therebetween for an elongate cylindrical abrading element, said element having an axis, each said driving cylinder having an axis angulated relative to each other driving cylinder and all driving cylinders having axes angulated at the same angle relative to the axis of the abrading element to frictionally contact the abrading element in the forward portions;

means for positionally maintaining the driving cylinders for rotation within the casement; and powering means to cause rotation of at least one of the driving cylinders to rotate the abrading element and move said abrasive element axially relative to the driving mechanism.

2. The tool of claim 1 further characterized by:

the means for positionally maintaining the driving cylinders comprising:

each driving cylinder having an axially aligned pin extending spacedly therefrom for journaling in the casement, and the powering means comprising:

each driving cylinder having a diametrically larger driving head in the rearward end portion, and a motor carried by the rearward end of the casement with a motor cylinder extending between at least the rearward portions of the driving heads.

3. The invention of claim 2 wherein each driving cylinder defines similar forward and rearward annular driving band grooves, with a forward elastic driving band extending about the forward set of grooves and a rearward elastic driving band extending about the rearward set of driving band grooves to bias the driving cylinders inwardly toward each other.

4. The erasing tool of claim 1 further characterized by:

the casement being elongate, having a forward septum, a medial septum and a rearward septum defining an eraser channel therethrough;

the means for positionally maintaining the driving cylinders comprising an axially aligned cylinder pin extending spacedly beyond each end of each driving cylinders and journaled respectively in the forward and rearward septa; and the powering means comprising a motor carried in the casement chamber rearward of the medial septum, with a driving shaft, extending forwardly through the medial septum, to irrotatably carry a drive band pulley aligned with rearward annular driving band channels defined in the driving cylinders, with an elastic driving band extending operatively about the rearward driving band channels and the driving pulley.

5. A powered erasing tool to rotate an elongate cylindrical erasing element, said erasing element having an axis, and to move the erasing element in an axial direction responsive to the rotary motion, comprising in combination:

a peripherally defined casement having an elongate tubular body with a forward end plate having a rearward portion at a first end and a rearward end plate at a second end to define an internal chamber, said forward end plate defining a medial eraser orifice with an annular cylinder pin groove thereabout in the rearward portion there of, and said rearward end plate defining a motor cylinder orifice;

driving mechanism carried in the casement chamber comprising three similar, symmetrically arrayed driving cylinders, each driving cylinder, having a forward end and rearward end, angulated to the other driving cylinders and all driving cylinders similarly angulated to the axis of an erasing element carried therebetween, each driving cylinder having a forward annular drive band groove defined thereabout inwardly adjacent the forward end, an axially aligned cylinder pin projecting spacedly beyond the forward ends of the cylinders for journaling in the cylinder groove of the forward end plate and in the rearward end plate respectively, a rearward drive band groove defined spacedly adjacent the rearward end of said cylinder, a radially larger driving head defined in the rearward portion of said cylinder, rearwardly of the rearward drive band groove, a forward drive band extending about said forward drive band groove of said cylinders and a rearward drive band extending about said rearward drive band grooves, each said drive band being of an elastic nature and of size to allow the passage of an erasing element between said driving cylinders in frictional contact with the forward end portions of said cylinders;

a motor carried by the rearward end plate, with a motor cylinder extending forwardly through the driving cylinder orifice and into the casement chamber between the rearward end portions of the driving heads of each driving cylinder, said motor cylinder being of a size to space the driving cylinders so that the rearward portions thereof do not contact a cylindrical erasing element extending therebetween.

6. A manually manipulatable powered erasing tool to rotate an elongate cylindrical erasing element and move the erasing element in an axial direction responsive to its rotation of the tool, comprising in combination:

a peripheral casement defining a chamber, said casement having a medial septum dividing the casement chamber into forward and rearward portions and said medial septum defining an eraser orifice, with an eraser support tube extending rearwardly from the medial septum through the rearward portion of the casement, a forward septum enclosing the forward portion of the casement chamber, said forward septum defining a medial eraser channel having an axis aligned with the eraser support tube, and a nose piece extending forwardly from the forward septum and defining an eraser channel coincident with the eraser orifice in the forward septum and extending therethrough in axial alignment with the eraser support tube;

a driving mechanism carried in the forward portion of the casement chamber comprising three similar elongate driving cylinders defining an eraser channel therebetween, each of said cylinders having a forward end portion and a rearward end portion and having an axially aligned mounting pin extending spacedly distant from each end and journaled in the medial and forward septa respectively, each driving cylinder defining a driving band channel inwardly adjacent the rearward end portion, and being angulated to the other driving cylinders and angulated similarly to the other driving cylinders relative to the axis of the eraser channel, said driving cylinders being arrayed so that the forward portion of each driving cylinder contacts an eraser carried in the eraser channel but the rearward portion of each driving cylinder is spacedly adjacent thereto;

a motor carried in the rearward portion of the casement chamber, with a drive shaft extending through the medial septum to irrotatably carry a driving pulley with a driving band operatively extending about the driving pulley and the driving band channel of at least one of the driving cylinders.

* * * * *